US009090038B1

(12) United States Patent
Bachman, Jr. et al.

(10) Patent No.: US 9,090,038 B1
(45) Date of Patent: Jul. 28, 2015

(54) METHOD FOR SETTING UP BOTTLE CARRIER BASKETS

(75) Inventors: Joseph L. Bachman, Jr., Villanova, PA (US); A. David Johnson, Jr., Malvern, PA (US); James Misko, Phoenixville, PA (US)

(73) Assignee: Wayne Automation Corporation, Norristown, PA (US)

( * ) Notice: Subject to any disclaimer, the term of this patent is extended or adjusted under 35 U.S.C. 154(b) by 775 days.

(21) Appl. No.: 13/354,956

(22) Filed: Jan. 20, 2012

(51) Int. Cl.
*B65B 21/00* (2006.01)
*B65B 43/26* (2006.01)
*B31B 19/90* (2006.01)

(52) U.S. Cl.
CPC ..... *B31B 19/90* (2013.01); *B65D 2571/0066* (2013.01); *B65D 2571/00388* (2013.01); *B65D 2571/00487* (2013.01); *B65D 2571/00975* (2013.01)

(58) Field of Classification Search
CPC ..... B65D 2571/0066; B65D 71/0022
USPC ..... 53/48.1, 48.9, 172, 173, 386.1, 381.1; 206/139, 141–143, 145, 161, 162, 164, 206/169, 170–173, 176, 193–196; 493/212
See application file for complete search history.

(56) References Cited

U.S. PATENT DOCUMENTS 2,246,243 A * 6/1941 Clark ..... 53/594
2,255,576 A * 9/1941 Wesselman ..... 53/48.1
2,263,411 A * 11/1941 Wesselman ..... 53/398
2,359,297 A * 10/1944 Brogden ..... 206/168
2,435,178 A * 1/1948 Marshall ..... 206/143
2,565,449 A * 8/1951 Emrick ..... 206/189
2,685,401 A * 8/1954 Guyer ..... 206/162
2,688,421 A * 9/1954 Forrer ..... 206/184
2,700,486 A * 1/1955 Arneson ..... 206/165
2,702,144 A * 2/1955 Forrer ..... 206/171
2,747,766 A * 5/1956 Bergstein ..... 206/171
2,779,499 A * 1/1957 Chidsey, Jr. ..... 206/141
2,991,908 A * 7/1961 Conescu ..... 206/171
3,140,036 A * 7/1964 Spery ..... 206/141
3,204,815 A * 9/1965 Weiss ..... 206/179
3,495,734 A * 2/1970 Hanna et al. ..... 206/183
3,814,237 A * 6/1974 Forrer ..... 206/167
4,406,365 A * 9/1983 Kulig ..... 206/188
4,469,222 A * 9/1984 Graser ..... 206/180
4,770,294 A * 9/1988 Graser ..... 206/180
5,167,325 A * 12/1992 Sykora ..... 206/143
5,400,901 A * 3/1995 Harrelson ..... 206/143
5,495,703 A * 3/1996 Kruit et al. ..... 53/398
5,518,110 A * 5/1996 Harrelson ..... 206/139
5,531,319 A * 7/1996 Harrelson ..... 206/162
5,538,131 A * 7/1996 Harrelson ..... 206/162
5,547,074 A * 8/1996 Plaxico et al. ..... 206/193

(Continued)

*Primary Examiner* — Stephen F Gerrity
*Assistant Examiner* — Eyamindae Jallow
(74) *Attorney, Agent, or Firm* — Michael R. Philips

(57) ABSTRACT

An apparatus and method is provided for setting up bottle carrier baskets from a flat folded configuration to an expanded and locked condition. The carrier basket is picked from a magazine storage location by a pick up head with vacuum cups and transferred to a pair of opposed opener heads with vacuum cups. The opener heads move along divergent paths to expand the carrier basket and a linear brake slows the carrier handle to cause the body to move past the handle, positioning a notch in the bottom panel to engage a hook in the central wall. A rotating kicker raises the bottom panel, engaging the hook and the notch as the vacuum is released from the opener vacuum cups.

10 Claims, 9 Drawing Sheets

(56) References Cited

U.S. PATENT DOCUMENTS

| | | | | | |
|---|---|---|---|---|---|
| 5,595,291 | A * | 1/1997 | Negelen | 206/143 |
| 5,680,930 | A * | 10/1997 | Stone | 206/173 |
| 5,884,756 | A * | 3/1999 | Holley et al. | 206/144 |
| 5,910,090 | A * | 6/1999 | Taute | 53/504 |
| 6,050,063 | A * | 4/2000 | Ford et al. | 53/458 |
| 6,168,013 | B1 * | 1/2001 | Gomes | 206/162 |
| 6,240,707 | B1 * | 6/2001 | Ford et al. | 53/381.1 |
| 6,371,287 | B1 * | 4/2002 | Jones et al. | 206/180 |
| 6,945,390 | B2 * | 9/2005 | Auclair | 206/141 |
| 7,093,408 | B2 * | 8/2006 | Duperray et al. | 53/398 |
| 7,267,224 | B2 * | 9/2007 | Cuomo | 206/175 |
| 7,753,196 | B2 * | 7/2010 | Cuomo | 206/188 |
| 7,913,837 | B2 * | 3/2011 | Cuomo | 206/162 |
| 8,297,437 | B2 * | 10/2012 | Smalley et al. | 206/170 |
| 8,453,832 | B2 * | 6/2013 | Skolik et al. | 206/170 |
| 2004/0031703 | A1 * | 2/2004 | Gomes et al. | 206/139 |
| 2005/0092623 | A1 * | 5/2005 | Cuomo | 206/162 |
| 2005/0109639 | A1 * | 5/2005 | Cuomo | 206/139 |
| 2005/0211577 | A1 * | 9/2005 | Bakx | 206/170 |
| 2006/0091024 | A1 * | 5/2006 | Cuomo | 206/170 |
| 2006/0169602 | A1 * | 8/2006 | Woog | 206/141 |
| 2006/0180482 | A1 * | 8/2006 | Cuomo | 206/139 |
| 2007/0017828 | A1 * | 1/2007 | Cuomo | 206/162 |
| 2007/0029211 | A1 * | 2/2007 | Cuomo | 206/162 |
| 2007/0199836 | A1 * | 8/2007 | Cuomo | 206/162 |
| 2007/0221512 | A1 * | 9/2007 | Cuomo | 206/173 |
| 2008/0210581 | A1 * | 9/2008 | Brand | 206/143 |
| 2008/0296177 | A1 * | 12/2008 | Cuomo | 206/173 |
| 2010/0006458 | A1 * | 1/2010 | Wilkins et al. | 206/170 |
| 2010/0320098 | A1 * | 12/2010 | Brand | 206/162 |
| 2013/0015080 | A1 * | 1/2013 | Loftin | 206/193 |

* cited by examiner

PROCESS CHART

1. Pick up head moves to contact flat carrier basket in magazine
2. Activate vacuum at pick up head to grip flat carrier basket
3. Pick up head moves flat carrier basket to load opener heads
4. Flat carrier basket contacts first opener head
5. Second opener head moves to contact flat carrier basket
6. Activate vacuum at opener heads to grip flat carrier basket
7. Deactivate vacuum at pick up head; activate a positive pressure blow off
8. Pick up head moves away
9. Opener heads move along diverging tracks to expand carrier basket
10. Cam device partly lifts carrier basket bottom panel
11. Slow speed belts grip handle of carrier basket
12. Opener heads move carrier basket body partly past handle
13. Kicker lifts bottom panel of carrier basket to engage a locking hook
14. Deactivate vacuum at opener heads; activate a positive pressure blow off
15. Sides of carrier basket spring forward to lock bottom when vacuum is off
16. Expanded and locked carrier basket is discharged

Fig. 12

METHOD FOR SETTING UP BOTTLE CARRIER BASKETS

FIELD OF THE INVENTION

The present invention relates to the field of equipment for opening packages to enable contents to be inserted, and more particularly to equipment for setting up bottle carrier baskets to enable bottles to be inserted therein.

BACKGROUND OF THE INVENTION

Beer in 12 fluid ounce bottles is sold in carrier baskets. The carrier basket is a paperboard container with two rows having three compartments each. Each bottle is held in a separate compartment. The necks of the bottles extend above the body section of the container and a handle of the container is positioned between the rows of bottle necks. In the case of small bottles of wine, e.g. containing 240 ml, the container is commonly made to hold four bottles.

Carrier baskets are made by die cutting paperboard sheets, gluing and folding the sheets into flat condition for reasons of shipping and warehousing space and efficiency. The carrier baskets must be expanded from their flat condition to be fully open in order to insert the bottles. The carrier basket has a locking hook to securely hold the open condition prior to inserting the bottles. In the traditional bottle packaging operation, the carrier baskets have been expanded manually. It will be understood that manual expanding of the carrier baskets is highly labor intensive.

SUMMARY OF THE INVENTION

The present invention provides an apparatus and method for automatically setting up bottle carrier baskets. The apparatus has a pick up head that acquires a single carrier basket in folded condition from a magazine storage position and places the folded carrier basket between a pair of opener heads. The pair of opener heads are moved along a pair of diverging paths to separate the opposed side panels of the carrier basket. As the side panels approach their fully separated condition and the carrier basket is almost fully expanded, the handle of the carrier basket is grasped by a linear brake to cause the side panels to travel farther than the handle in order to position a locking hook for engagement. With the locking hook positioned for engagement, a rotary kicker is brought into rapid contact with the bottom panel, effecting engagement with the hook. The carrier basket is now in fully set up condition and ready for bottles to be inserted.

BRIEF DESCRIPTION OF THE DRAWINGS

The present invention is best understood in conjunction with the accompanying drawing figures in which like elements are identified by similar reference numerals. In the drawings, lines of double dashes indicate visible fold lines, lines of dots indicate hidden fold lines, and lines of single dashes indicate hidden structure edges.

FIG. 12 is a process chart setting forth the method of the invention.

DETAILED DESCRIPTION OF THE PREFERRED EMBODIMENT

Figure 1:
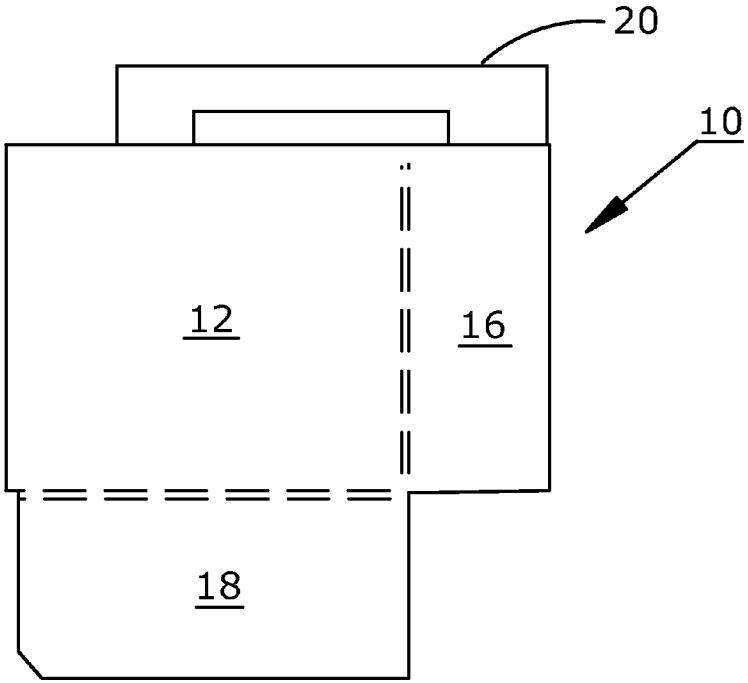
FIG. 1 is a side elevation view of a bottle carrier basket in flat folded condition.

Referring to FIG. 1, a carrier basket 10 is illustrated as supplied to the apparatus of the present invention, carrier basket 10 being in the folded flat condition. The visible portions of carrier basket 10 are side panel 12, end panel 16, bottom panel 18, and handle 20. In the folded flat condition, the visible portions of end panel 16 and bottom panel 18 are each substantially one half of the respective full panel, the second half being hidden in this view. The double dashed line separating side panel 12 from end half-panel 16 and the double dashed line separating side panel 12 from bottom half-panel 18 represent score lines to facilitate accurate folding when carrier basket 10 is expanded. Interior details of carrier basket 10 are not shown for reasons of clarity. Carrier basket 10 is typically formed of a paperboard sheet that is coated for durability and printing quality. As used herein, the term "setting up" encompasses the process of expanding the carrier basket from the folded flat condition to a state where the side panels thereof are separated and cells are formed for holding individual bottles in addition to the process of locking the bottom panel to maintain the expanded condition and allow bottles to be readily inserted.

Figure 2:
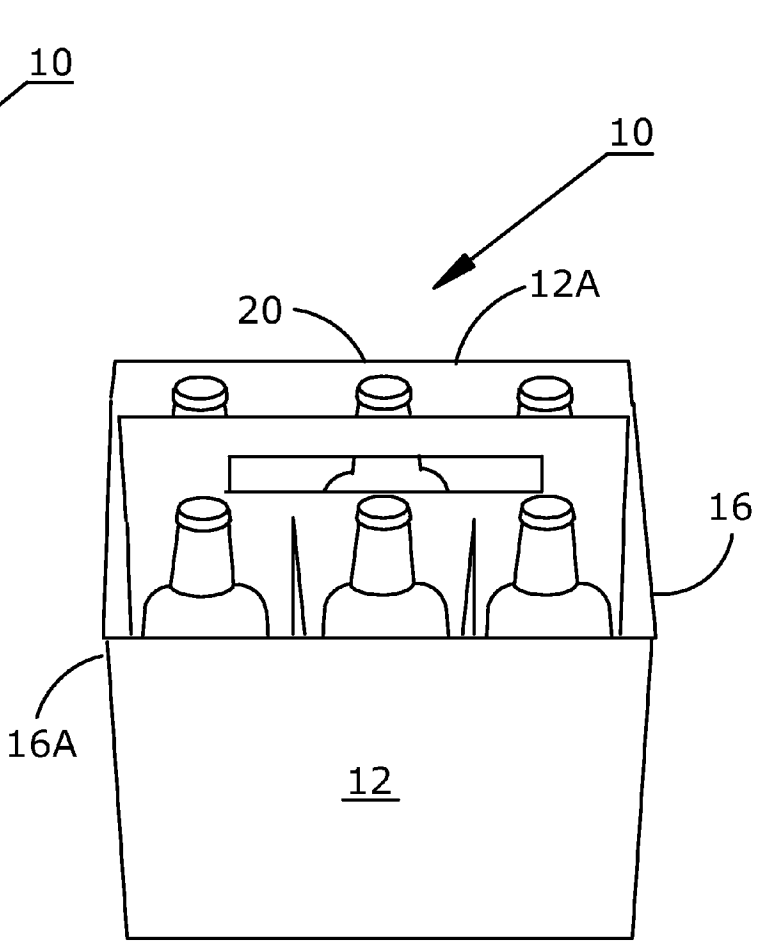
FIG. 2 is a top perspective view of the carrier basket of FIG. 1 after it has been fully expanded and filled with bottles.

Referring now to FIG. 2, carrier basket 10 is illustrated in top perspective view as fully set up and after the insertion of six bottles. Whereas the description herein of the invention depicts a six bottle carrier basket, it is understood that the principles of the invention apply similarly to carrier baskets with a capacity of holding different numbers of bottles. As shown, a second side panel 12*a* is positioned opposite to side panel 12 and a second end panel 16*a* is positioned opposite to end panel 16. Bottom panel 18 (see FIG. 1) is hidden from view. Handle 20 is now positioned in the center of carrier basket 10 between the necks of the bottles.

Figure 3A:
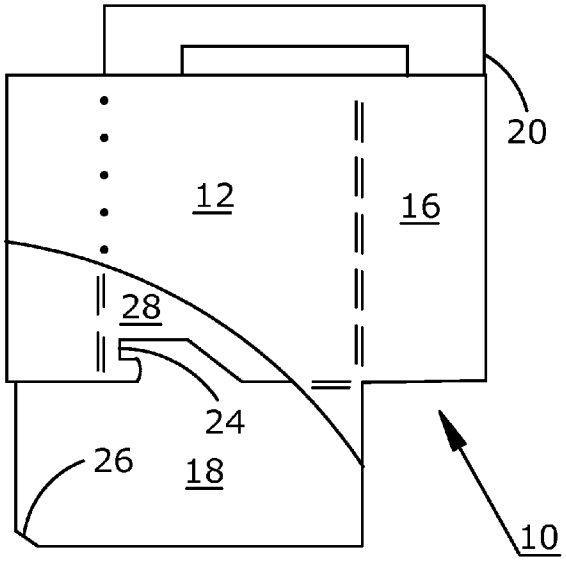
FIG. 3A is the carrier basket of FIG. 1 in flat folded condition with a portion cut away to clearly show an internal locking hook.
Figure 3B:
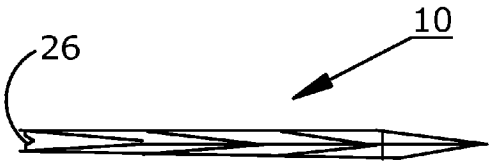
FIG. 3B is a top plan view of the carrier basket of FIG. 3A.

Referring now to FIG. 3A, carrier basket 10 is shown in similar view to drawing FIG. 1, with a portion of side panel 12 and a portion of bottom panel 18 cut away to show a locking hook 24 that is formed in the lower edge of a center panel 28. The upper portion of center panel 28 forms handle 20. A notch 26 is formed at a lower left corner of bottom panel 18. When carrier basket 10 is expanded, notch 26 will be engaged with locking hook 24. FIG. 3B shows a top plan view of carrier basket 10 in the folded flat condition shown and described in relation to FIG. 3A.

Figure 4A:
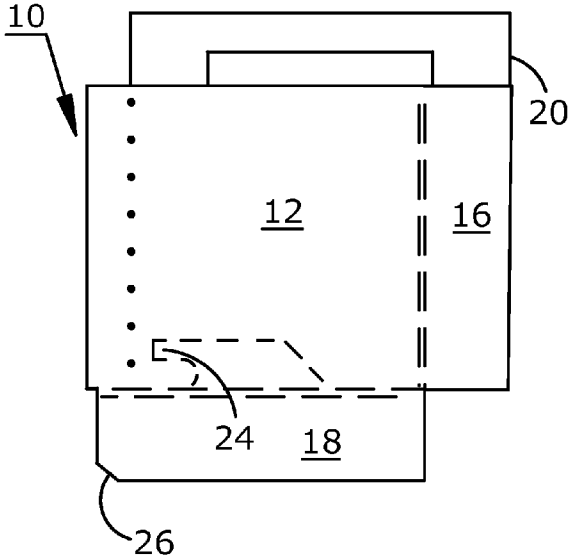
FIG. 4A is the carrier basket of FIG. 3A in partly expanded condition.
Figure 4B:
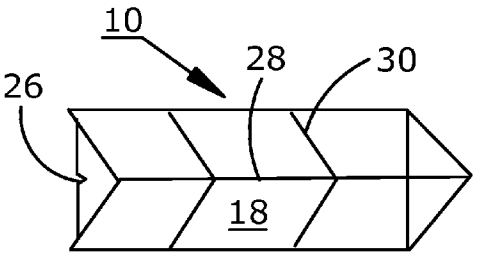
FIG. 4B is a top plan view of the carrier basket of FIG. 4A.

Referring now to FIGS. 4A and 4B, carrier basket 10 is shown in partially expanded condition. As illustrated, side panel 12 and the opposite side panel (not visible) are somewhat separated from each other and end panel 16 and bottom panel 18 are each oriented at an angle, therefore appearing to be dimensionally smaller. A plurality of separators 30 are beginning to open and form individual compartments into which a plurality of bottles will be inserted.

Figure 5A:
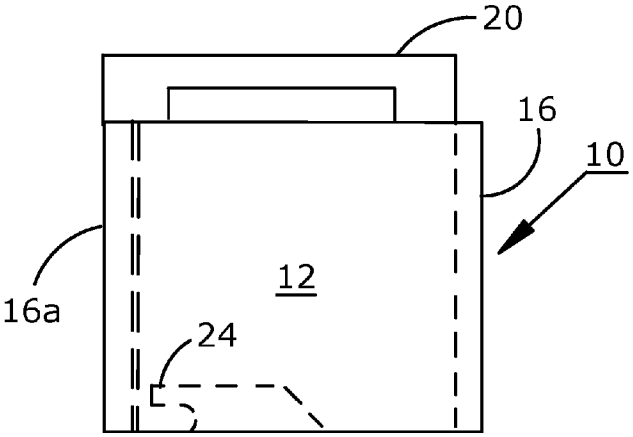
FIG. 5A is the carrier basket of FIG. 4A that is expanded beyond the shape for inserting bottles to engage the locking hook.
Figure 5B:
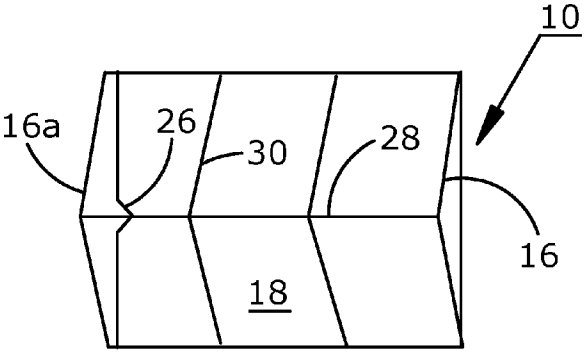
FIG. 5B is a top plan view of the carrier basket of FIG. 5A.

Referring now to FIGS. 5A and 5B, carrier basket 10 is shown in fully expanded condition with end panel 16 and opposite end panel 16*a* pushed past their final positions in order to allow notch 26 to be moved upward into engagement with locking hook 24. In this condition, handle 20 is offset to the left of center, first end panel 16 is indented, and opposite end panel 16*a* protrudes beyond bottom panel 18.

Figure 6A:
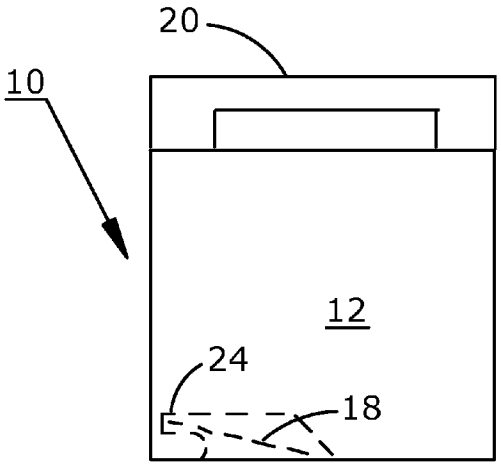
FIG. 6A is the carrier basket of FIG. 5A in fully expanded condition for inserting bottles and with the locking hook engaged.
Figure 6B:
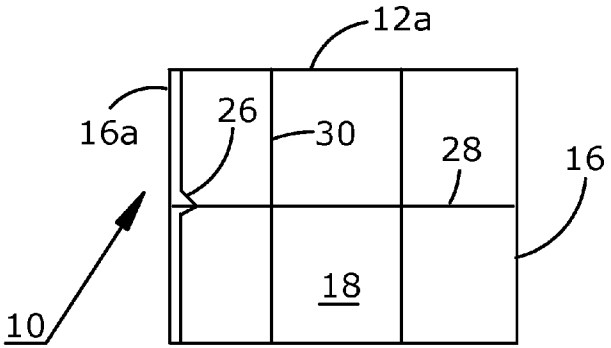
FIG. 6B is a top plan view of the carrier basket of FIG. 6A.

Referring now to FIGS. 6A and 6B, carrier basket 10 is shown as fully expanded in condition to receive a bottle in each of the 6 compartments defined by center panel 28, separators 30, end panels 16, 16*a* and side panels 12, 12*a*. Bottom panel 18 has been pushed upward to engage notch 26 with locking hook 24.

Figure 7:
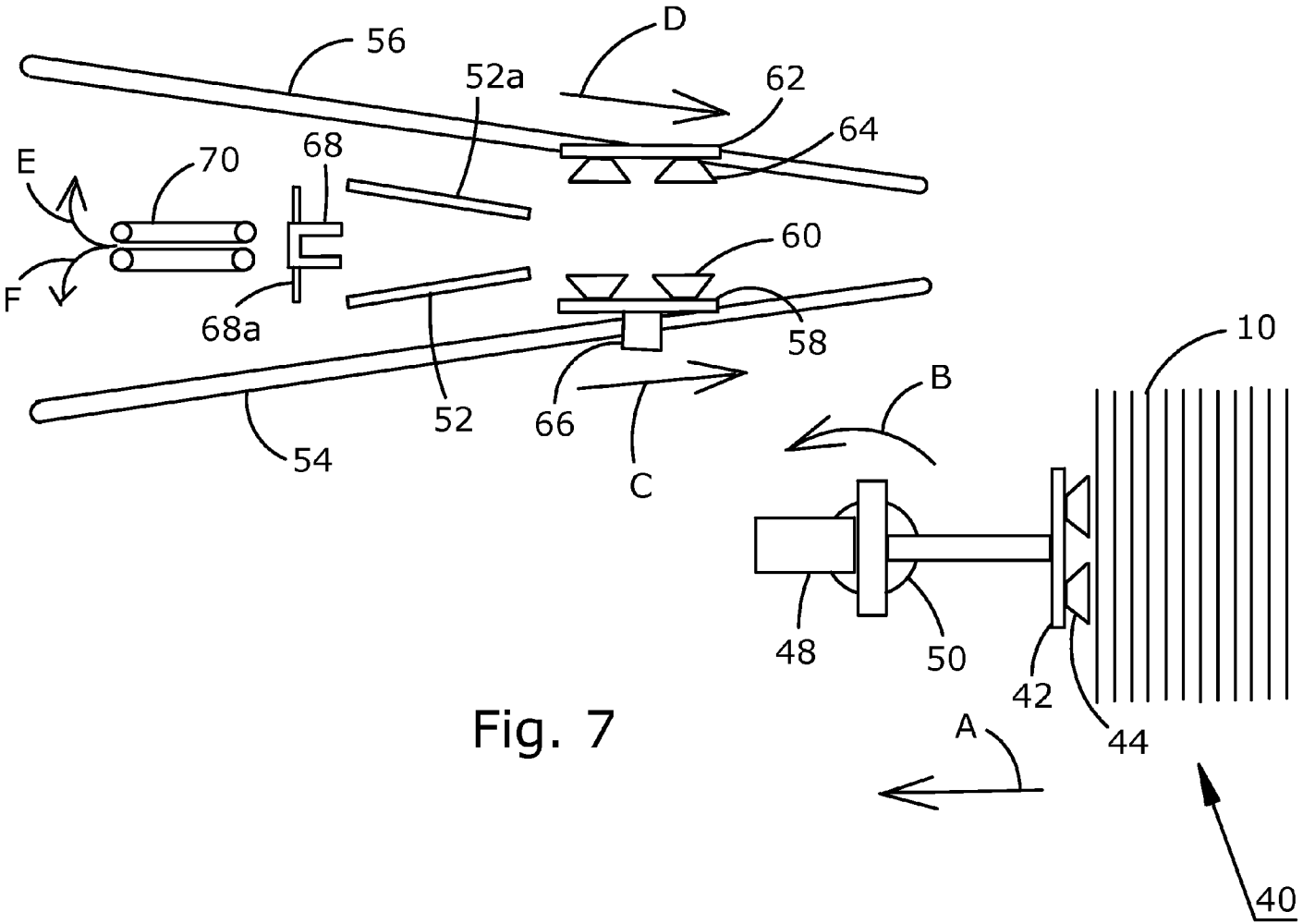
FIG. 7 is a top plan view of the apparatus of the present invention for setting up bottle carrier baskets at a first stage.

Referring now to FIG. 7, a top plan view is shown of the apparatus for setting up bottle carrier baskets. It is understood that the apparatus described herein is mounted to a frame and the motions described are driven by motors with appropriate mechanisms or by pneumatic actuators. These mechanical details are not shown for reasons of clarity. In addition, the details of connective pressure and vacuum lines are omitted. A plurality of carrier baskets 10 in flat configuration are held in a magazine storage unit 40. A pick up head 42 with means for grasping a flat carrier basket, e.g. a plurality of vacuum cups 44 connected to a forward surface thereof, is positioned adjacent to a first flat carrier basket 10. In the preferred embodiment of the invention, four vacuum cups 44 are mounted to pick up head 42 in a rectangular array. A partial vacuum is applied to vacuum cups 44 for gripping carrier basket 10. A linear actuator 48 will retract pick up head 42 with flat carrier basket 10 in the direction indicated by arrow A. Next, a rotary actuator 50 will turn pick up head with flat carrier basket 10 in the direction indicated by arrow B by substantially 90°. A pair of opener heads 58 and 62 are mounted respectively to a pair of guide rails 54 and 56 for movement therealong. Guide rails 54 and 56 are horizontally coplanar and oriented at an angle to one another to cause opener heads 58 and 62 to travel along divergent paths when expanding a flat carrier basket 10, as will be described below. As illustrated, opener heads 58 and 62 are returning in the direction indicated by arrows C and D respectively toward a position where guide rail 54 and guide rail 56 are closest to one another and in substantial alignment with the center of rotation of rotary actuator 50. Opener heads 58 and 62 each have means for grasping a flat carrier basket, e.g. a plurality of vacuum cups 60 and 64, respectively. In the preferred embodiment of the invention, two vacuum cups 60 and 64 are mounted to each opener head 58 and 62 in a linear array. An extender mechanism 66, e.g. a pneumatic cylinder, mounts opener head 58 to guide rail 54.

Referring further to FIG. 7, a pair of angularly oriented cam rods 52 and 52*a* are mounted generally within the enclosure of guide rails 54 and 56 and at a lower level to be in a position to contact the bottom panel of carrier basket 10 as appropriate. Cam rods 52 and 52*a* may be substituted by a flat or angled plate at the discretion of the designer. A linear brake 70, e.g. a pair of driven belts, is provided between the diverged ends of guide rails 54 and 56 to grip the handle of carrier basket 10 near the end of the process described. The belts of linear brake 70 are driven rotationally in opposed directions as indicated by arrows E and F. An actuator, e.g. kicker 68, is mounted for rotation to a shaft 68*a* in a position below linear brake 70. The operation of cam rods 52 and 52*a* and of linear brake 70 will be described in detail below.

Figure 8:
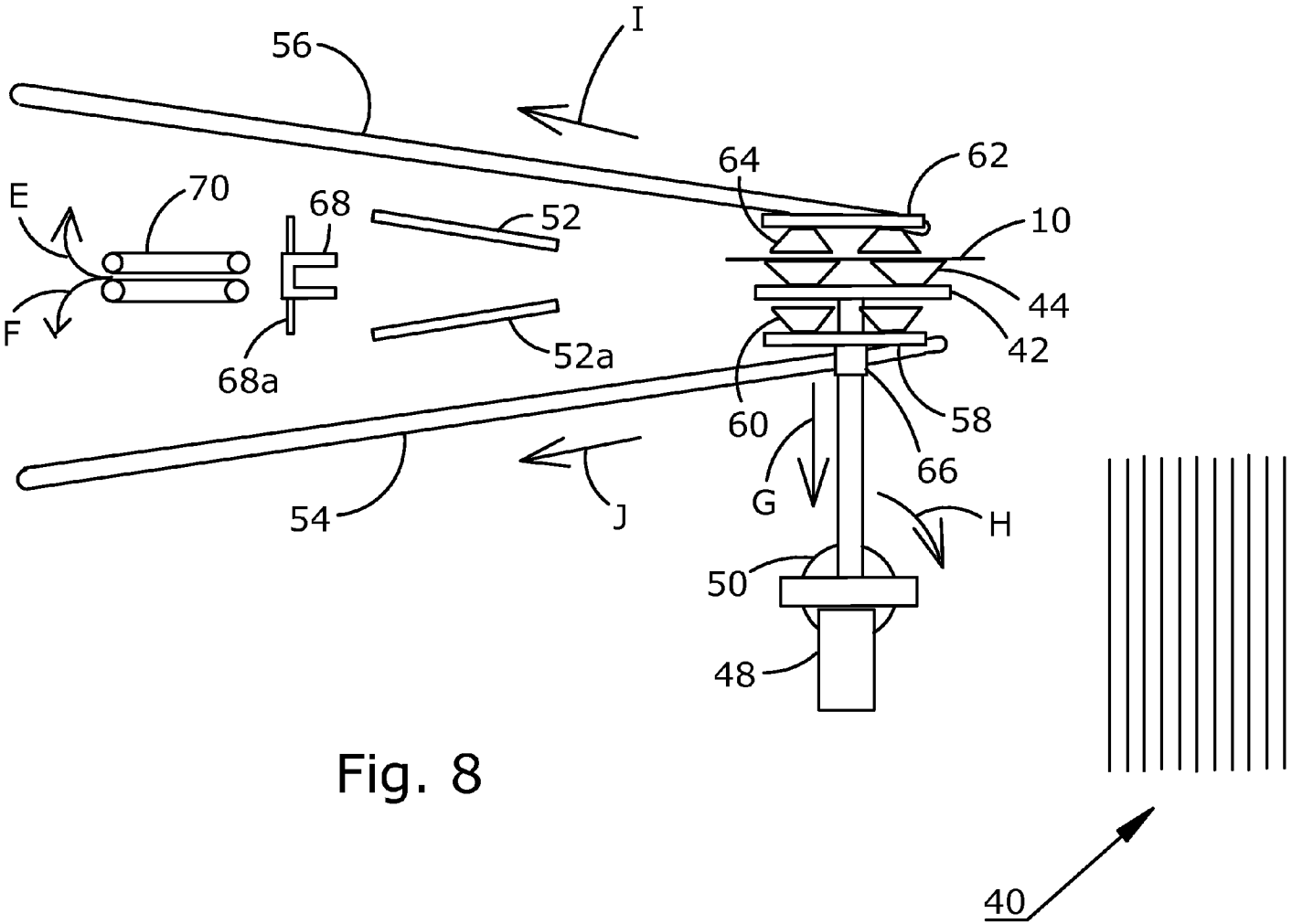
FIG. 8 is the apparatus of FIG. 7 at a second stage.

Referring now to FIG. 8, opener head 58 with vacuum cups 60 and opener head 62 with vacuum cups 64 have moved along angled guide rails 54 and 56 to a position opposite to the center of rotation of rotary actuator 50. Vacuum cups 60 and vacuum cups 64 are relatively distant from one another. Pick up head 42 with vacuum cups 44 has been extended by linear actuator 48 and rotated by rotary actuator 50 to position flat carrier basket 10 substantially in contact with vacuum cups 64 of opener head 62. Second opener head 58 with vacuum cups 60 is next extended by extender 66 to cause vacuum cups 60 to contact flat carrier basket 10. It is noted that pick up head 42 and vacuum cups 44 remain in contact with carrier basket 10 at a different vertical level than opener heads 58 and 62 to avoid interference. Once vacuum cups 60 and 64 are in contact with carrier basket 10, a partial vacuum is applied to vacuum cups 60 and 64. The partial vacuum that had been applied to pick up vacuum cups 44 is released and a slight blow off positive pressure is activated to rapidly disengage vacuum cups 44 from carrier basket 10. With carrier basket 10 held by opener heads 58 and 62, pick up head 42 is moved rotationally in the direction indicated by arrow H and linearly in the direction indicated by arrow G by rotary actuator 50 and linear actuator 48, respectively. As pick up head 42 is moved away, opener heads 58 and 62 are moved synchronously along guide rails 54 and 56 in the directions indicated by arrows I and J.

Figure 9:
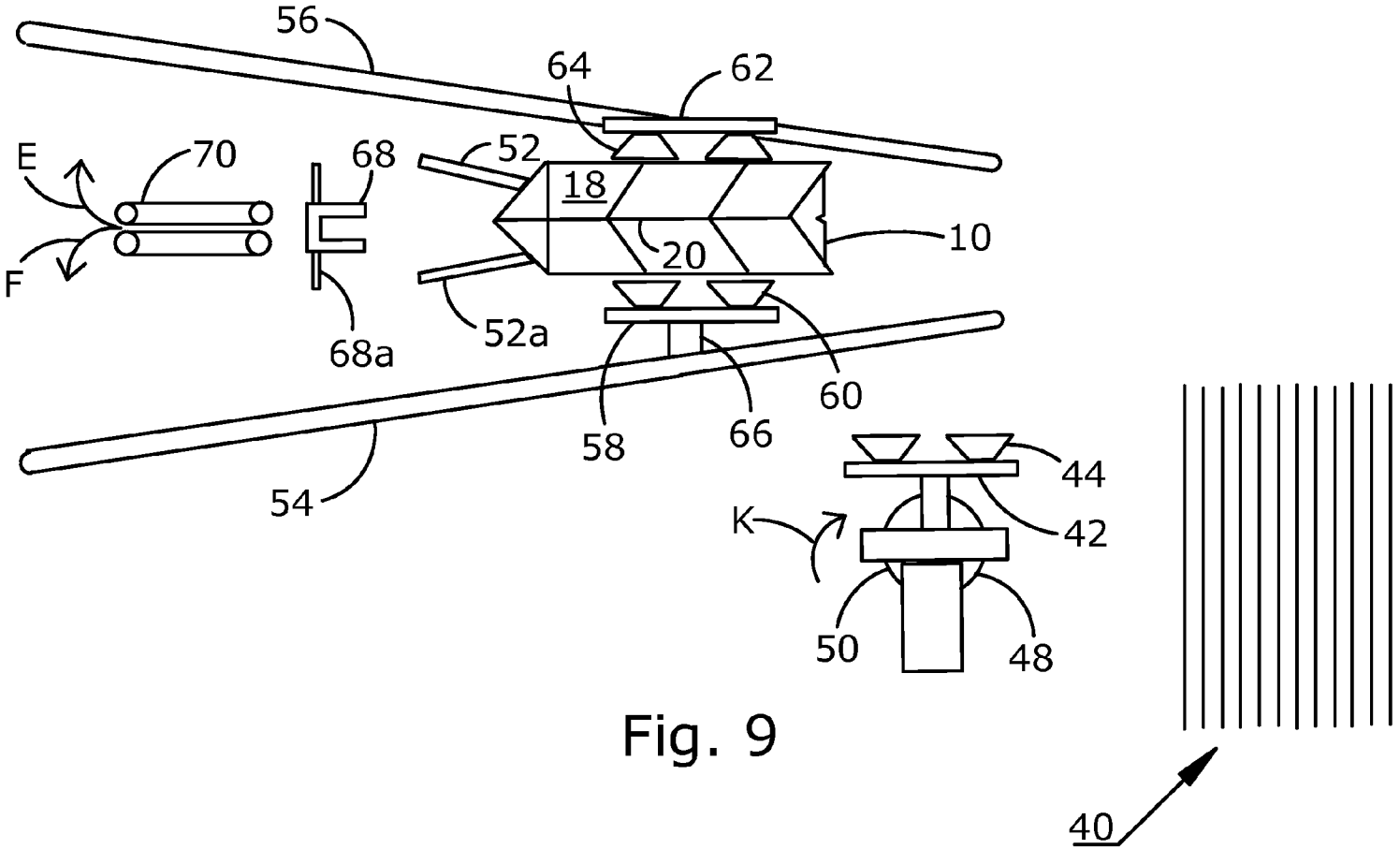
FIG. 9 is the apparatus of FIG. 7 at a third stage.

Referring now to FIG. 9, pick up head 42 is returned to a position opposite to magazine 40 to next move in the direction indicated by arrow K. Opener heads 58 and 62 are moving along guide rails 54 and 56 and diverging to partly expand carrier basket 10. Handle 20 is indicated in the center of carrier basket 10. At this position, bottom 18 of carrier basket 10 contacts cam rods 52 and 52*a* that are oriented for lifting bottom 18 as carrier basket 10 is moved by opener heads 58 and 62. The two opposed belts comprising linear brake 70 are continuously rotating in the direction indicated by arrows E and F, as described above. Handle 20 is in alignment to pass between the belts of linear brake 70.

Figure 10:
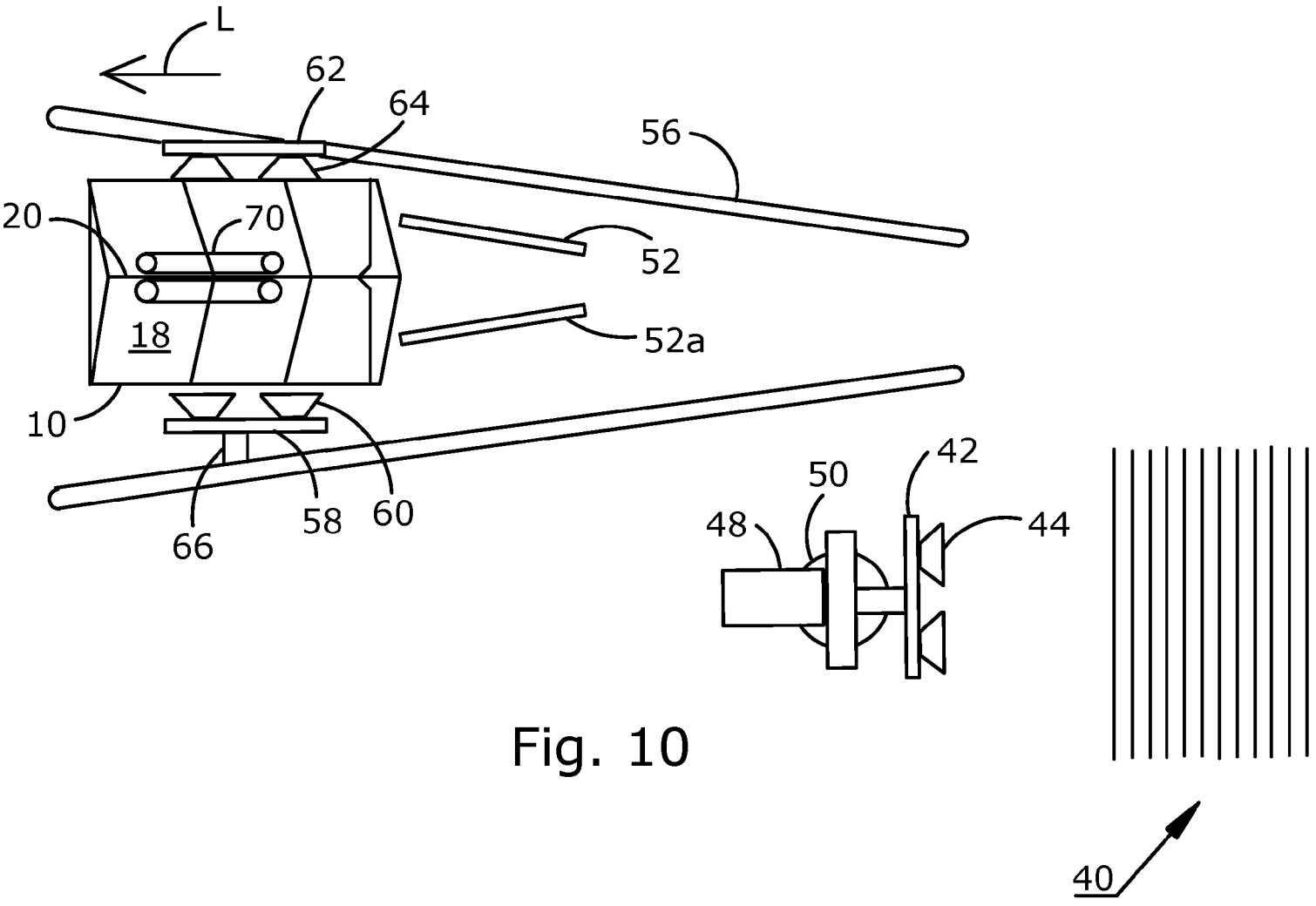
FIG. 10 is the apparatus of FIG. 7 at a fourth stage.

Referring now to FIG. 10, it is seen that opener heads 58 and 62, through vacuum cups 60 and 64, have fully expanded carrier basket 10. Handle 20 is gripped between the two belts comprising linear brake 70. Motion of linear brake 70 in the direction indicated by arrow L is at a slower rate of speed than opener heads 58 and 62 to retard handle 20 relative to the body of carrier basket 10. With handle 20 gripped by linear brake 70 and the side walls of carrier basket 10 held by vacuum cups 60 and 64, the side walls of carrier basket 10 will advance beyond handle 20, causing bottom 18 to extend beyond the end wall of carrier basket 10. This over-expanded condition of carrier basket 10 allows hook 24 to engage notch 26 (see FIG. 3A), as described further below.

Figure 11:
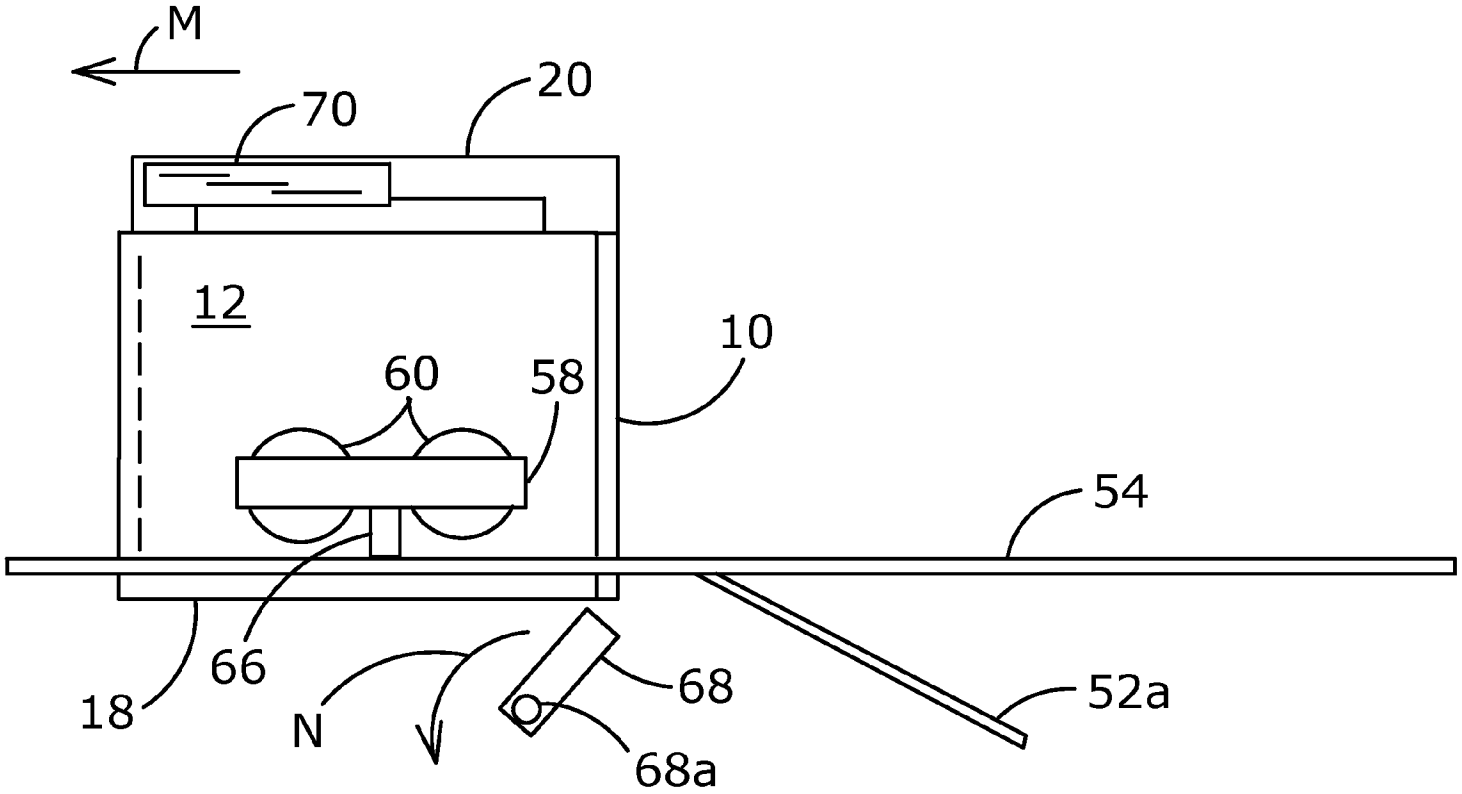
FIG. 11 is a side elevation view of the apparatus of FIG. 7 at the fourth stage.

Referring now to FIG. 11, a side elevation view is shown of the apparatus for setting up bottle carrier baskets of the invention with carrier basket 10 at the final stage of being expanded. Carrier basket 10 has been moved along guide rail 54 by opener head 58 in the direction indicated by arrow M. As carrier basket 10 is expanded, side panels 12 thereof (only one side visible in this view) are separated, and bottom 18 thereof is gradually unfolded to arrive at a substantially flat condition as was described above. Cam rods 52*a* (only one rod visible in this view) are oriented at an angle below horizontal to assist in the unfolding and flattening of bottom 18. It is understood that alternate component forms to cam rods

52*a*, e.g. an angularly oriented flat plate or an angularly oriented plate with a "V" contour are within the scope of the present invention. Kicker 68 rotates on shaft 68*a* in the direction indicated by arrow N at a higher circumferential speed than the linear speed of opener head 58, e.g. three times as fast. The effect of higher speed is to enable kicker 68 to rapidly impact bottom 18 to cause the notch 26 (FIG. 3A) to overthrow the hook and become mutually engaged. At the same time or very slightly after kicker 68 impacts bottom 18 of carrier basket 10, the partial vacuum is released from opener vacuum cups 60 and a short blast of positive pressure blow off air is introduced to cleanly release carrier basket 10. Carrier basket 10 is thereby released to a discharge chute, conveyor or similar device to pass to further operations.

Referring now to FIG. 12, a process chart is provided to define the method steps conducted according to the invention. In step 1, a pick up head moves to place vacuum heads thereof into contact with a first flat carrier basket held in a magazine feed device. With the pick up head in contact with the flat carrier basket, a vacuum is actuated to the pick up head for gripping the flat carrier basket in step 2. In step 3, the pick up head moves the flat carrier basket from the magazine and in step 4, the flat carrier basket is brought into contact with a first opener head. In step 5, a second opener head is brought into contact with the flat carrier basket. In step 6, a partial vacuum is activated to the first and second opener heads. In step 7, the vacuum to the pick up head is deactivated and a positive pressure blow off is activated. In step 8, the pick up head retracts to clear the area of the opener heads. In step 9, the first and second opener heads are moved along a pair of diverging tracks to expand the carrier basket. In step 10, the bottom panel of the carrier basket contacts a lifting cam device. In step 11, a pair of belts, driven at a slower linear speed in the same direction as the movement of the opener heads, grips a handle of the carrier basket, causing the handle to move at a slower speed than the body of the carrier basket. In step 12, the carrier basket body is moved past the carrier basket handle to position a notch in the carrier basket bottom panel for engagement with a hook formed in the carrier basket central wall. In step 13, a kicker lifts the bottom panel of the carrier basket to engage the notch with the locking hook. In step 14, the vacuum to the opener heads is deactivated and a positive pressure blow off is activated. In step 15, the sides of the carrier basket spring forward to lock the set up carrier basket. In step 16, the fully expanded and locked carrier basket is discharged.

While the description above discloses the preferred embodiment of the present invention, it is contemplated that numerous variations and modifications of the invention are possible and are considered to be within the scope of the claims that follow.

What is claimed is:

1. A method for setting up bottle carrier baskets comprising the steps of:

a. picking up a flat carrier basket from a storage unit;
b. moving the flat carrier basket into contact with a first opener head;
c. contacting the flat carrier basket with a second opener head, the second opener head being opposed to the first opener head;
d. activating a partial vacuum to vacuum cups of the first and second opener heads and grasping the flat carrier basket with the first and second opener heads;
e. moving the first opener head and the second opener head away from each other to expand the flat carrier basket;
f. moving a handle portion of the expanded carrier basket relative to a body portion of the expanded carrier basket to position a notch in a bottom portion for engagement with a hook in a central wall thereof;
g. engaging the notch and the hook by causing an actuator to lift a portion of the bottom panel of the carrier basket to position the notch adjacent to the hook and releasing the partial vacuum on the opener head vacuum cups; and
h. discharging the set up bottle carrier basket.

2. The method for setting up bottle carrier baskets described in claim 1, wherein the step of picking up the flat carrier basket from a storage unit comprises moving a pick up head having a plurality of suction cups into contact with a flat carrier basket and activating a partial vacuum to the vacuum cups.

3. The method for setting up bottle carrier baskets described in claim 1, wherein the step of contacting the flat carrier basket with a second opener head comprises the step of actuating an extender mechanism to which the second opener head is mounted to cause the second opener head to advance and contact the flat carrier basket.

4. The method for setting up bottle carrier baskets described in claim 1, wherein the step of moving the first opener head and the second opener head away from each other to expand the flat carrier basket comprises moving the first and second opener heads along a pair of coplanar divergent guide rails.

5. The method for setting up bottle carrier baskets described in claim 1, wherein the step of moving a handle portion of the expanded carrier basket relative to a body portion of the expanded carrier basket comprises retarding the motion of the handle portion relative to the motion of the body portion of the carrier basket.

6. The method for setting up bottle carrier baskets described in claim 1, further comprising the step of lifting the bottom panel of the carrier basket with a cam device to contact the bottom panel as the side panels of the carrier basket are separated.

7. A method for setting up bottle carrier baskets comprising the steps of:

a. picking up a flat carrier basket from a storage unit;
b. moving the flat carrier basket into contact with a first opener head;
c. contacting the flat carrier basket with a second opener head, the second opener head being opposed to the first opener head;
d. grasping the flat carrier basket with the first and second opener heads;
e. moving the first opener head and the second opener head away from each other to expand the flat carrier basket;
f. engaging a handle portion of the expanded carrier basket with a linear brake to position a notch in a bottom portion of the carrier basket for engagement with a hook in a central wall thereof;
g. rotating a kicker to rapidly impact the bottom portion of the carrier basket to cause the notch to overthrow the hook and become mutually engaged; and
h. discharging the set up bottle carrier basket.

8. The method for setting up bottle carrier baskets described in claim 7, wherein the first and second opener heads include vacuum cups and the step of grasping the flat carrier basket comprises activating a partial vacuum to the vacuum cups of the first and second opener heads.

9. The method for setting up bottle carrier baskets described in claim 8, wherein the step of causing the notch to overthrow the hook and become mutually engaged further comprises the step of releasing the partial vacuum on the opener head vacuum cups.

10. The method for setting up bottle carrier baskets described in claim 7, wherein the step of moving the first opener head and the second opener head away from each other to expand the flat carrier basket comprises moving the first and second opener heads along a pair of coplanar divergent guide rails.

* * * * *